US007640936B2

(12) United States Patent
Rabiei et al.

(10) Patent No.: US 7,640,936 B2
(45) Date of Patent: Jan. 5, 2010

(54) PREPARATION OF MIXED METAL OXIDE CATALYSTS FROM NANOSCALE PARTICLES

(75) Inventors: Shahryar Rabiei, Richmond, VA (US); Firooz Rasouli, Midlothian, VA (US); Mohammad R. Hajaligol, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 569 days.

(21) Appl. No.: 10/972,202

(22) Filed: Oct. 25, 2004

(65) Prior Publication Data

US 2005/0263162 A1 Dec. 1, 2005

Related U.S. Application Data

(60) Provisional application No. 60/514,527, filed on Oct. 27, 2003.

(51) Int. Cl.
*A24D 3/16* (2006.01)

(52) U.S. Cl. ..... 131/365; 131/334; 131/374; 502/304

(58) Field of Classification Search ..... None
See application file for complete search history.

(56) References Cited

U.S. PATENT DOCUMENTS

| | | | |
|---|---|---|---|
| 3,720,214 | A | 3/1973 | Martin et al. |
| 3,807,416 | A | 4/1974 | Hedge et al. |
| 3,931,824 | A | 1/1976 | Miano et al. |
| 4,108,151 | A | 8/1978 | Martin et al. |
| 4,109,663 | A | 8/1978 | Maeda et al. |
| 4,119,104 | A | 10/1978 | Roth |
| 4,182,348 | A | 1/1980 | Seehfer et al. |
| 4,193,412 | A | 3/1980 | Heim et al. |
| 4,195,104 | A | 3/1980 | Fell |
| 4,195,645 | A | 4/1980 | Bradley, Jr. et al. |
| 4,197,861 | A | 4/1980 | Keith |
| 4,317,460 | A | 3/1982 | Dale et al. |

(Continued)

FOREIGN PATENT DOCUMENTS

| | | |
|---|---|---|
| EP | 0499402 A1 | 8/1992 |

(Continued)

OTHER PUBLICATIONS

Commonly Owned Applications in Connection With U.S. Appl. No. 10/972,202 U.S. Appl. No. 10/460,617, Preparation of Intermetallics by Metallo-Organic Decomposition, filed Jun. 13, 2003.

(Continued)

*Primary Examiner*—Philip C Tucker
*Assistant Examiner*—Michael J Felton
(74) *Attorney, Agent, or Firm*—Buchanan Ingersoll & Rooney PC

(57) ABSTRACT

Mixed metal oxide catalysts are prepared by combining first nanoscale particles and second nanoscale particles to form a mixture of nanoscale particles and then the mixture is heated to form a mixed metal oxide catalyst. The mixed metal oxide catalysts, which are capable of reducing the concentration of carbon monoxide in the mainstream smoke of a cigarette during smoking, are incorporated into a smoking article component such as tobacco cut filler, cigarette paper and/or cigarette filter material.

7 Claims, 2 Drawing Sheets

U.S. PATENT DOCUMENTS

| | | | | |
|---|---|---|---|---|
| 4,450,847 | A | 5/1984 | Owens | |
| 4,453,553 | A | 6/1984 | Cohn | |
| 4,489,739 | A | 12/1984 | Mattina, Jr. et al. | |
| 4,744,374 | A | 5/1988 | Deffeves et al. | |
| 5,101,839 | A | 4/1992 | Jakob et al. | |
| 5,105,836 | A | 4/1992 | Gentry et al. | |
| 5,129,408 | A | 7/1992 | Jakob et al. | |
| 5,211,684 | A | 5/1993 | Shannon et al. | |
| 5,284,166 | A | 2/1994 | Cartwright et al. | |
| 5,386,838 | A | 2/1995 | Quincy, III et al. | |
| 5,499,636 | A | 3/1996 | Baggett, Jr. et al. | |
| 5,525,556 | A | 6/1996 | Dunmead et al. | |
| 5,580,536 | A * | 12/1996 | Yao et al. | 423/263 |
| 5,598,868 | A | 2/1997 | Jakob et al. | |
| 5,666,976 | A | 9/1997 | Adams et al. | |
| 5,671,758 | A | 9/1997 | Rongved | |
| 5,692,525 | A | 12/1997 | Counts et al. | |
| 5,692,526 | A | 12/1997 | Adams et al. | |
| 5,718,462 | A | 2/1998 | Woods | |
| 5,727,573 | A | 3/1998 | Meier et al. | |
| 5,744,118 | A | 4/1998 | Imamura et al. | |
| 5,915,387 | A | 6/1999 | Baggett, Jr. et al. | |
| 5,988,176 | A | 11/1999 | Baggett, Jr. et al. | |
| 6,026,820 | A | 2/2000 | Baggett, Jr. et al. | |
| 6,095,152 | A | 8/2000 | Beven et al. | |
| 6,121,191 | A | 9/2000 | Komatsu et al. | |
| 6,138,684 | A | 10/2000 | Yamazaki et al. | |
| 6,228,904 | B1 | 5/2001 | Yadav et al. | |
| 6,286,516 | B1 | 9/2001 | Bowen et al. | |
| 6,312,643 | B1 | 11/2001 | Upadhya et al. | |
| 6,326,329 | B1 | 12/2001 | Nunan | |
| 6,371,127 | B1 | 4/2002 | Snaidr et al. | |
| 6,482,387 | B1 | 11/2002 | Gulgun et al. | |
| 6,769,437 | B2 | 8/2004 | Hajaligol et al. | |
| 6,782,892 | B2 | 8/2004 | Li et al. | |
| 6,857,431 | B2 | 2/2005 | Deevi et al. | |
| 7,004,993 | B2 | 2/2006 | Pithawalla et al. | |
| 7,152,609 | B2 | 12/2006 | Li et al. | |
| 7,165,553 | B2 | 1/2007 | Luan et al. | |
| 7,168,431 | B2 | 1/2007 | Li et al. | |
| 7,228,862 | B2 | 6/2007 | Hajaligol et al. | |
| 7,243,658 | B2 | 7/2007 | Deevi et al. | |
| 2002/0002979 | A1 | 1/2002 | Bowen et al. | |
| 2002/0062834 | A1 | 5/2002 | Snaidr et al. | |
| 2003/0037792 | A1 | 2/2003 | Snaidr et al. | |
| 2003/0075193 | A1 | 4/2003 | Li et al. | |
| 2003/0131859 | A1 | 7/2003 | Li et al. | |
| 2004/0110633 | A1 * | 6/2004 | Deevi et al. | 502/304 |

FOREIGN PATENT DOCUMENTS

| | | | |
|---|---|---|---|
| GB | 973845 | A | 10/1964 |
| WO | WO 87/06104 | A1 | 10/1987 |
| WO | WO 00/40104 | A1 | 7/2000 |
| WO | WO 02/24005 | A2 | 3/2002 |
| WO | WO 02/37990 | A2 | 5/2002 |

OTHER PUBLICATIONS

U.S. Appl. No. 10/460,631, Catalyst to Reduce Carbon Monoxide in the Mainstream Smoke of a Cigarette, filed Jun. 13, 2003.

U.S. Appl. No. 10/460,302, Oxidant/Catalyst Nanoparticles to Reduce Tobacco Smoke Constituents Such as Carbon Monoxide, filed Jun. 13, 2003.

U.S. Appl. No. 10/972,205, Formation and Deposition of Sputtered Nanoscale Particles in Cigarette Manufacture, filed Oct. 25, 2004.

U.S. Appl. No. 10/972,209, In Situ Synthesis of Composite Nanoscale Particles, filed Oct. 25, 2004.

U.S. Appl. No. 10/972,201, Tobacco Cut Filler Including Metal Oxide Supported Particles, filed Oct. 25, 2004.

U.S. Appl. No. 10/972,202, Preparation of Mixed Metal Oxide Catalysts From Nanoscale Particles, filed Oct. 25, 2004.

U.S. Appl. No. 10/972,203, Cigarettes and Cigarette Components Containing Nanostructured Fibril Materials, filed Oct. 25, 2004.

U.S. Appl. No. 10/866,181, Cigarette Wrapper With Catalytic Filler and Methods of Making Same, filed Jun. 14, 2004.

U.S. Appl. No. 10/870,449, Shredded Paper With Catalytic Filler in Tobacco Cut Filler and Methods of Making Same, filed Jun. 14, 2004.

U.S. Appl. No. 10/972,206, Reduction of Carbon Monoxide in Smoking Articles Using Transition Metal Oxide Clusters, filed Oct. 25, 2004.

U.S. Appl. No. 10/868,015, Silver and Silver Oxide Catalysts for the Oxidation of Carbon Monoxide in Cigarette Smoke, filed Jun. 16, 2004.

U.S. Appl. No. 10/972,208, Reduction of Carbon Monoxide and Nitric Oxide in Smoking Articles Using Nanoscale Particles and/or Clusters of Nitrided Transition Metal Oxides, filed Oct. 25, 2004.

U.S. Appl. No. 11/252,773, Palladium-Containing Nanoscale Catalysts, filed Oct. 19, 2005.

U.S. Appl. No. 10/972,207, Use of Oxyhydroxide Compounds in Cigarette Paper for Reducing Carbon, filed Oct. 25, 2004.

U.S. Appl. No. 10/972,295, Cigarette Wrapper With Nanoparticle Spinel Ferrite Catalyst and Methods of Making Same, filed Oct. 25, 2004.

U.S. Appl. No. 10/972,204, In Situ Synthesis of Composite Nanoscale Particles, filed Oct. 25, 2004.

U.S. Appl. No. 11/653,856, Cigarette Components Having Encapsulated Catalyst Particles and Methods of Making and Use Thereof, filed Jan. 17, 2007.

U.S. Appl. No. 11/636,589, Supported Catalysts, filed Dec. 11, 2006.

U.S. Appl. No. 11/729,951, In Situ Formation of Catalytic Cigarette Paper, filed Mar. 30, 2007.

U.S. Appl. No. 11/698,192, Catalysts to Reduce Carbon Monoxide Such as in the Mainstream Smoke of a Cigarette, filed Jan. 26, 2007.

U.S. Appl. No. 10/950,663, Nanocomposite Copper-Ceria Catalysts for Low Temperature or Near-Ambient Temperature Catalysis and Methods for Making Such Catalysts, filed Sep. 28, 2004.

U.S. Appl. No. 11/252,849, Gold-Ceria Catalyst for Oxidation of Carbon Monoxide, filed Oct. 19, 2005.

U.S. Appl. No. 11/452,995, Gold-Ceria Catalyst for Oxidation of Carbon Monoxide, filed Jun. 15, 2006.

U.S. Appl. No. 11/370,843, Method for Forming Activated Copper Oxide Catalysts, filed Mar. 9, 2006.

U.S. Appl. No. 11/371,021, Catalysts for Low Temperature Oxidation of Carbon Monoxide, filed Mar. 9, 2006.

U.S. Appl. No. 11/641,003, Corrugated Catalytic Cigarette Paper and Cigarettes Comprising the Same, filed Dec. 19, 2006.

U.S. Appl. No. 11/077,554, Methods for Forming Transition Metal Oxide Clusters and Smoking Articles Comprising Transition Metal Oxide Clusters, filed Mar. 11, 2005.

U.S. Appl. No. 10/560,396, Cigarette Wrapper With Printed Catalyst, filed Nov. 2, 2006.

International Preliminary Report on Patentability for PCT/IB2004/003622 dated May 1, 2006.

International Search Report and Written Opinion of the International Searching Authority for PCT/IB2004/003622 dated May 27, 2005.

* cited by examiner

PREPARATION OF MIXED METAL OXIDE CATALYSTS FROM NANOSCALE PARTICLES

This application claims priority under 35 U.S.C. § 119 U.S. Provisional Application No. 60/514,527 PREPARATION OF MIXED METAL OXIDE CATALYSTS FROM NANOSCALE PARTICLES, filed Oct. 27, 2003, the entire content of which is hereby incorporated by reference.

BACKGROUND

Smoking articles, such as cigarettes or cigars, produce both mainstream smoke during a puff and sidestream smoke during static burning. One constituent of both mainstream smoke and sidestream smoke is carbon monoxide (CO). The reduction of carbon monoxide in smoke is desirable.

Despite the developments to date, there remains an interest in improved and more efficient methods and compositions for reducing the amount of carbon monoxide in the mainstream smoke of a smoking article during smoking.

SUMMARY

A preferred method for making a cigarette comprising a mixed metal oxide catalyst comprises combining first nanoscale particles and second nanoscale particles to form a mixture of nanoscale particles, wherein the first nanoscale particles comprise a first metallic element and the second nanoscale particles comprise a second metallic element different from the first metallic element; heating the mixture of nanoscale particles to form a mixed metal oxide catalyst; incorporating the mixed metal oxide catalyst in and/or on at least one of tobacco cut filler, cigarette paper and cigarette filter material; providing the cut filler to a cigarette making machine to form a tobacco column; placing the paper around the tobacco column to form a tobacco rod of a cigarette and joining the tobacco rod to a filter with tipping paper. The filter can optionally comprise mixed metal oxide catalysts.

A preferred method of making a component of a smoking article comprising mixed metal oxide catalysts comprises combining first nanoscale particles and second nanoscale particles to form a mixture of nanoscale particles, wherein the first nanoscale particles comprise a first metallic element and the second nanoscale particles comprise a second metallic element different from the first metallic element; heating the mixture of nanoscale particles to form a mixed metal oxide catalyst; and incorporating the mixed metal oxide catalyst in and/or on at least one of tobacco cut filler, cigarette paper and cigarette filter material.

In one embodiment, the first nanoscale particles can comprise a metal and/or a metal oxide and/or the second nanoscale particles can comprise a metal and/or a metal oxide. Preferably the mixed metal oxide catalysts comprise two or more phases that are derived from first and second nanoscale particles.

According to a preferred embodiment, the first and second nanoscale particles can comprise a Group IIIB element, a Group IVB element, a Group IVA element, a Group VA element, a Group VIA element, a Group VIIA element, a Group VIIIA element, a Group IB element, zinc, yttrium, a rare earth metal, and mixtures thereof. For example, the first nanoscale particles can comprise copper oxide and the second nanoscale particles can comprise titanium oxide or the first nanoscale particles can comprise copper oxide and the second nanoscale particles can comprise cerium oxide. In another example, the first nanoscale particles can comprise iron oxide and the second nanoscale particles can comprise at least one of copper oxide, titanium oxide and cerium oxide. The first nanoscale particles preferably have an average particle size of less than about 50 nm, more preferably less than about 10 nm, and the second nanoscale particles preferably have an average particle size of less than about 50 nm, more preferably less than about 10 nm. The first and second nanoscale particles can have a crystalline structure and/or an amorphous structure.

In a preferred embodiment, the first and second nanoscale particles are combined in proportions sufficient to form a mixed metal oxide catalyst capable of converting at least 10% of the carbon monoxide in mainstream smoke to carbon dioxide. In a further embodiment, the mixed metal oxide catalyst is incorporated on and/or in at least one of tobacco cut filler and cigarette paper in an amount effective to convert at least 10% of the carbon monoxide in mainstream smoke to carbon dioxide. The first and second nanoscale particles are preferably combined in the absence of a liquid or binder. Optionally, additional nanoscale particles such as third nanoscale particles comprising a third metallic element different from the first and second metallic elements can be combined with the mixture of nanoscale particles.

In the preferred method, the mixture of nanoscale particles can be heated in the absence of a liquid or binder at a temperature of less than about 1000° C., preferably less than about 800° C. According to a preferred embodiment, the mixture of nanoscale particles can be heated to a temperature sufficient to at least partially sinter first nanoscale particles to second nanoscale particles. The heating can comprise heating at a temperature of less than about 50% of the melting point of said first nanoscale particles and less than about 50% of the melting point of said second nanoscale particles.

The heating can comprise heating at a rate of between about 1 to 40° C. per minute or at a heating rate of greater than about 40° C. per minute such as greater than about 100° C. per minute.

The mixed metal oxide catalyst preferably has an average particle size of less than about 1 micron, more preferably less than about 100 nm and a surface area of greater than about $1m^2/g$, more preferably greater than about $5m^2/g$.

The heating, which is preferably performed at about atmospheric pressure, can be performed in an at least partially or wholly inert, reducing or oxidizing atmosphere. For example, the heating can be performed in an atmosphere comprising $H_2$, He, $N_2$, Ar, air, $O_2$ and mixtures thereof.

According to an embodiment, the mixed metal oxide catalyst can be combined with filter material that is incorporated into a cigarette. The filter material can comprise a mono filter, a dual filter, a triple filter, a cavity filter, a recessed filter or a free-flow filter.

The mixed metal oxide catalysts can also be incorporated into one or more cigarette filter parts selected from the group consisting of a shaped paper insert, a plug, a space between plugs, cigarette filter paper, a cellulose acetate sleeve, a polypropylene sleeve, and a free-flow sleeve. The mixed metal oxide catalyst can be incorporated in and/or on the smoking article component by spraying, dusting and/or mixing.

According to a further embodiment, a smoking article component such as tobacco cut filler, cigarette paper and cigarette filter material can comprise a mixed metal oxide catalyst. A cigarette comprising tobacco cut filler, cigarette paper and optional cigarette filter material can comprise the mixed metal oxide catalysts wherein the mixed metal oxide catalysts are incorporated in and/or on at least one of the tobacco cut filler, cigarette paper and filter material.

A preferred method of smoking a smoking article comprising a mixed metal oxide catalyst comprises lighting the smoking article to form tobacco smoke and drawing the tobacco smoke through the smoking article, wherein during the smoking of the smoking article, the mixed metal oxide catalyst reduces the amount of carbon monoxide in the tobacco smoke.

DETAILED DESCRIPTION OF PREFERRED EMBODIMENTS

Figure 1A:
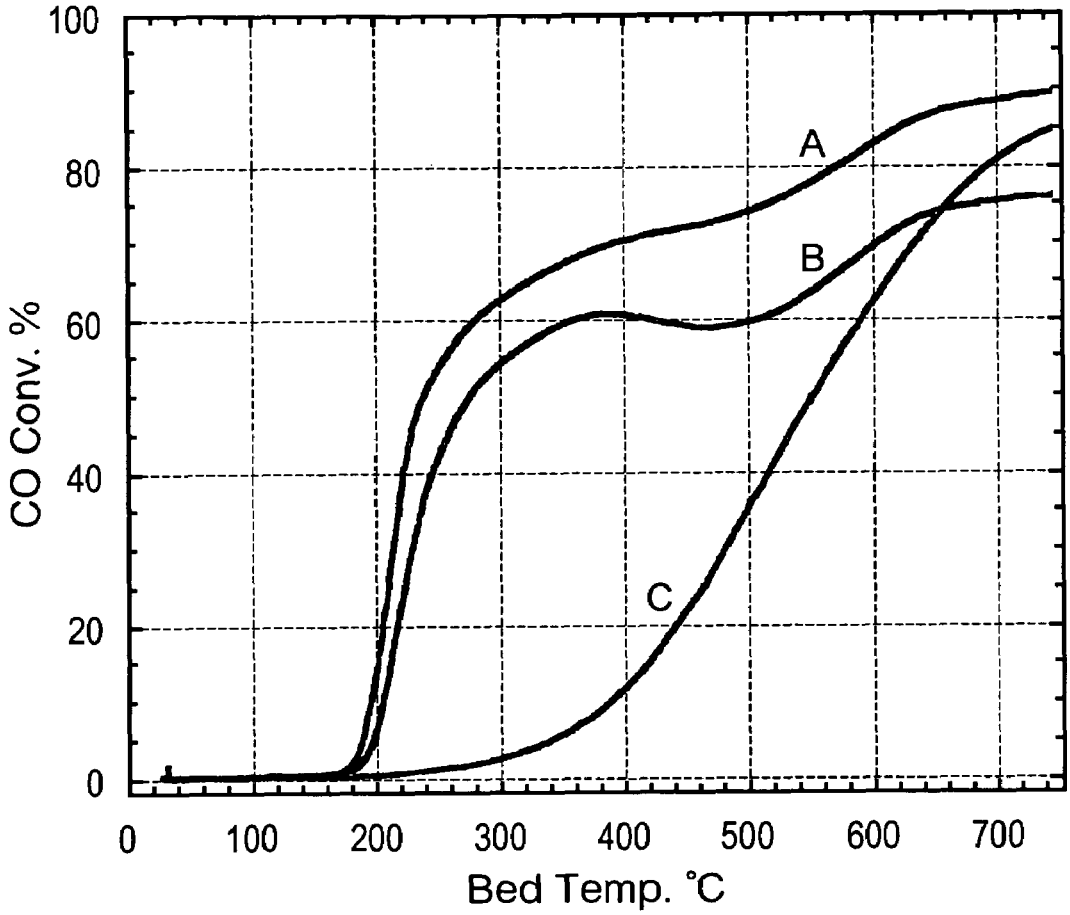
FIG. 1A shows the variation of percentage conversion of CO to $CO_2$ with sample temperature for a 60 wt % CuO-40 wt. % $CeO_2$ mixed metal oxide catalyst heated in pure helium at 700° C. Curve (A) represents the percentage of CO conversion for the mixed metal oxide catalyst, and curves (B-C) represent the percentage of CO conversion for the constituent CuO and $CeO_2$ nanoscale particles, respectively.

In accordance with a preferred method of making a mixed metal oxide catalyst for use in smoking articles and in smoking article components, a mixture of nanoscale particles is heated to form the mixed metal oxide catalyst. Preferably the mixture of nanoscale particles comprises first nanoscale particles and second nanoscale particles, wherein the first nanoscale particles comprise a first metallic element and the second nanoscale particles comprise a second metallic element different from the first metallic element.

In a preferred use, the mixed metal oxide catalysts, which can be used in the form of a powder or after they are formed can be combined with a liquid to form a paste or a dispersion, are particularly useful for low-temperature catalysis and/or oxidation of carbon monoxide to carbon dioxide in smoking articles. The mixed metal oxide catalysts can catalyze and/or oxidize carbon monoxide to carbon dioxide at higher temperatures. By "low-temperature" is meant temperatures below about 300° C.

The mixed metal oxide catalysts can be incorporated in and/or on a smoking article component selected from the group consisting of tobacco cut filler, cigarette paper and cigarette filter material. One or more smoking article components comprising the mixed metal oxide catalysts can be use to form a smoking article such as a cigarette.

Preferably at least the first and second nanoscale particles are combined to form a mixture of nanoscale particles. The mixture of nanoscale particles is heated to form the mixed metal oxide catalysts, wherein during the heating of the mixture of nanoscale particles, the first nanoscale particles are at least partially sintered to the second nanoscale particles. Thus, the mixed metal oxide catalysts comprise a composite powder of one or more metal oxides. The mixed metal oxide catalysts can have the general formula $A_xB_yO_z$, where A and B represent first and second metallic elements, O is oxygen, and x, y and z>0.

According to an embodiment, the nanoscale particles can comprise commercially available particles such as metal or metal oxide nanoscale particles that comprise Group IIIB elements (B, Al); Group IVB elements (Si, Ge, Sn); Group IVA elements (Ti, Zr, Hf); Group VA elements (V, Nb, Ta); Group VIA elements (Cr, Mo, W), Group VIIIA elements (Fe, Co, Ni, Ru, Rh, Pd, Os, Ir, Pt); Group IB elements (Cu, Ag, Au), zinc, yttrium, a rare earth metal such as cerium and mixtures thereof. For example, the nanoscale particles can comprise one or more of titanium, iron, copper and cerium.

According to a preferred embodiment, the first nanoscale particles comprise copper oxide and the second nanoscale particles comprise titanium oxide. According to another preferred embodiment, the first nanoscale particles comprise copper oxide and the second nanoscale particles comprise cerium oxide. According to yet a further preferred embodiment, the first nanoscale particle comprise iron oxide and the second nanoscale particles comprise at least one of copper oxide, titanium oxide and cerium oxide. Cerium oxide is a preferred constituent in the mixed metal oxide catalysts because as either $CeO_2$ or doped $CeO_2$, an equilibrium between $Ce^{3+}$ and $Ce^{4+}$ can result in an exceptionally high oxygen storage and release capacity that enables catalytic combustion of CO by providing oxygen directly to catalytically active sites. Also, $CeO_2$ is less susceptible to deactivation from water vapor and more resistant to sintering than other oxides such as $A1_2O_3$.

Preferably, at least one of the first and second nanoscale particles comprise iron oxide. The mixture of nanoscale particles can comprise nanoscale iron oxide particles. For instance, MACH I, Inc., King of Prussia, PA sells nanoscale iron oxide particles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a surface area of about 40 $m^2/g$.

Iron oxide is a preferred constituent in the catalyst because iron oxide can have a dual function as a CO catalyst in the presence of oxygen and as a CO oxidant for the direct oxidation of CO in the absence of oxygen. A catalyst that can also be used as an oxidant is especially useful for certain applications, such as within a burning cigarette where the partial pressure of oxygen can be very low.

Nanoscale particles are a class of materials whose distinguishing feature is that their average diameter, particle or other structural domain size is below about 500 nanometers. The first and/or second nanoscale particles preferably have an average particle size less than about 100 nm, more preferably less than about 50 nm, and most preferably less than about 10 nm.

The composition of the mixed metal oxide catalysts can be expressed as a weight percentage (% wt.) of the constituent nanoscale particles. For example, the composition can be expressed as the weight percent of the first and second nanoscale particles that are combined to form the mixed metal oxide catalyst. The ratio of first and/or second nanoscale particles in the mixed metal oxide can vary from about 1 to 99%.

In addition to first and second nanoscale particles, which comprise first and second metals and/or metal oxides, respectively, the mixture of nanoscale particles can further comprise additional nanoscale particles. Additional nanoscale particles such as third and optionally fourth nanoscale particles preferably comprise third or fourth metallic elements, respectively, that are different from first and second metallic elements. For example, first and second nanoscale particles can comprise copper oxide (e.g., CuO) and cerium oxide (e.g., $CeO_2$), respectively, and third nanoscale particles can comprise titanium oxide or iron oxide (e.g., $TiO_2$ or FeO or $Fe_2O_3$ or $Fe_3O_4$). Also, additional nanoscale particles can comprise third or fourth metallic elements that are the same as the first or second metallic elements. For example, first and second nanoscale particles can comprise copper oxide (e.g., CuO) and cerium oxide (e.g., $CeO_2$), respectively, and third nanoscale particles can comprise copper oxide (e.g., $CU_2O$ ).

The nanoscale particles that are combined to form the mixture of nanoscale particles can comprise a crystalline structure, an amorphous structure or combination of crystalline and amorphous phases. For example, the mixture of nanoscale particles can comprise from about 1-99 wt. % crystalline and/or amorphous first nanoscale particles and from about 1-99 wt. % crystalline and/or amorphous second nanoscale particles.

Preferably the steps of combining the nanoscale particles and heating the mixture of nanoscale particles are done in the absence of binders and liquids. Thus, the first and second nanoscale particles can be combined in predetermined proportions and heated at a preselected temperature for a desired time under a particular atmosphere to form the mixed metal oxide catalyst. According to a preferred embodiment, the mixture of nanoscale particles consists of nanoscale particles such as only the first and second nanoscale particles (e.g., the mixture is free of additives such as binders, liquids, solvents, etc.).

The heating, which can be performed in any suitable furnace, oven or the like, is preferably carried out in either a totally or partially reducing or inert gas atmosphere such as an atmosphere comprising hydrogen, helium, nitrogen, argon or mixtures thereof, or in a totally or partially oxidizing gas atmosphere such as an atmosphere comprising air and/or oxygen. For convenience in processing, the heating can be performed at about atmospheric pressure, although the heating can be performed at higher or lower pressures.

The mixture of nanoscale particles can be heated at a temperature of less than about 1000° C., preferably less than about 800° C. Preferably the mixture of nanoscale particles is heated at a temperature of less than about 50% of the melting point of the nanoscale particles. According to an embodiment, heating comprises heating at a temperature of less than about 50% of the melting point of both the first and second nanoscale particles. Preferably the mixture of nanoscale particles is heated to a temperature sufficient to cause the nanoscale particles to at least partially sinter to each other.

The heating can comprise increasing to a temperature at a heating rate of greater than about 1° C./min., such as between about 1 to 40° C./min. using a conventional tube furnace or oven. The heating can comprise increasing to a temperature at a heating rate greater than about 40° C./min. For example, by using a conventional rapid thermal annealing (RTA) oven, the mixture of nanoscale particles can be heated to a temperature at a heating rate of greater than about 100° C./min.

By heating the mixture of nanoscale particles, the resulting mixed metal oxide catalysts can comprise single phase or mixed phase nanoscale particles, agglomerated nanoscale particles and/or at least partially sintered nanoscale particles. Preferably the mixed metal oxide catalysts have an average particle size of less than about 1 micron, more preferably less than about 100 nm.

During the heating, the surface area of the nanoscale particles may be reduced. As shown in Table I, when heated, the surface area of titanium oxide and copper oxide nanoscale particles decreases. The mixed metal oxide catalysts can have a surface area of greater than about 1 $m^2/g$, or greater than about 5 $m^2/g$, or greater or less than about 50 $m^2/g$. The mixture of nanoscale particles is preferably heated to a temperature and for a length of time insufficient to fully densify the mixture of nanoscale particles. During the heating the surface area of the nanoscale particles may decrease but the time and temperature of heating are insufficient to cause substantial densification of the nanoscale particles from viscous flow (i.e., during the heating the nanoscale particles do not sinter into a monolithic piece). Thus, the mixed metal oxide catalyst comprises a partially sintered or partially densified physical admixture of at least first nanoscale particles and second nanoscale particles. The mixed metal oxide catalysts can comprise a powder.

At the relatively low temperature at which the mixture of nanoscale particles is heated, the particles can agglomerate as surface forces (van der Waals forces) overcome gravitational forces. During the heating, the driving force for nanoscale particles to partially sinter together (i.e., via solid state diffusion) is the reduction of surface area. The change in surface area, ΔS, can be expressed as a function of the initial surface area, $S_0$, by the following relationship: $\Delta S=-S_0k_s(X/D)^m$, where X is the diameter of the flat contact area (between particles), D is the diameter of the particles, and $k_s$ and m are constants. The value of X is an indication of the extent of sintering.

While the first and second nanoscale particles may partially sinter during the heating, the mixed metal oxide catalysts comprise at least two phases. That is, the mixed metal oxide catalysts comprise a first phase corresponding to the first nanoscale particles and a second phase corresponding to the second nanoscale particles. Preferably the mixed metal oxide catalysts comprise a first phase and a second phase that are the same as the two respective phases in the first and second nanoscale particles before heating. If the mixture of nanoscale particles is heated to a sufficiently high temperature, however, a phase change may occur in one or more of the constituent nanoscale particles. For example, first or second nanoscale particles may comprise anatase ($TiO_2$), which can form rutile ($TiO_2$) if heated to a sufficiently high temperature. Preferably the mixture of first and second nanoscale particles is not heated at a specified temperature for a specified time sufficient to form a single phase solid solution.

The mixed metal oxide catalysts can be formed using more than one heating step, such as a first heating step that is carried out under one atmosphere such a reducing atmosphere or inert atmosphere, and a second heating step that is carried out under a different atmosphere such an oxidizing atmosphere. During single or multiple heating steps the composition of the nanoscale particles can change. For example, copper nanoscale particles can oxidize to form copper oxide nanoparticles, i.e., cupric oxide (CuO), cuprous oxide ($Cu_2O$) and mixtures thereof.

By way of example, copper oxide-cerium oxide and copper oxide-titanium oxide mixed metal oxide catalysts can be prepared by combining nanoscale copper oxide particles with either nanoscale cerium oxide particles or nanoscale titanium oxide particles. The nanoscale particle mixtures, which consist essentially of about 10, 20, 30, 40, 50, 60, 70, 80 or 90 wt. % copper oxide and 90, 80, 70, 60, 50, 40, 30, 20 or 10 wt. % cerium oxide; or 10, 20, 30, 40, 50, 60, 70, 80 or 90 wt. % copper oxide and 90, 80, 70, 60, 50, 40, 30, 20 or 10 wt. % titanium oxide, can be heated at about 12° C./min. to 700° C. in 1000 sccm of flowing helium for 2 hours to form the mixed metal oxide catalysts. In order to compare the catalytic activity of the mixed metal oxide catalysts with the catalytic activity of the constituent nanoscale particles, unmixed nanoscale particles (e.g., copper oxide (sample A), cerium oxide (sample B) or titanium oxide (sample C)) were also heated under identical conditions.

Large quantities, for example several hundred milligrams, of the mixed metal oxide catalyst can be prepared economically and efficiently using this process in less than 5 hours total, e.g., preferably about 2.5 hours total. As part of the process, the heat treatment can be performed in a short time period, such as about 1 hour. Conventional furnace heating or rapid thermal annealing (RTA) can be used to heat a mixture of nanoscale particles under a controlled atmosphere. While preferred embodiments of the process can be carried out in short time periods, variations in the process will be apparent to those skilled in the art. Moreover, the process can be easily scaled up, to make larger quantities of mixed metal oxide catalysts.

The mixed metal oxide catalysts can be tested for their catalytic ability using any suitable method. For example, the mixed metal oxide catalysts produced according to the methods described above can be tested to determine effectiveness in oxidation of carbon monoxide. The activity of mixed metal oxide catalysts can be evaluated using a continuous flow packed bed reactor positioned within a programmable tube furnace. Type K thermocouples can be used to monitor the temperature of the furnace and of the mixed metal oxide catalyst within the reactor. To evaluate the ability of the mixed metal oxide catalyst to reduce the concentration of carbon monoxide, about 100 mg of the mixed metal oxide catalyst (or comparative metal oxide) is dusted onto quartz wool and placed in the middle of the reactor. A filter pad can be used to prevent particulate material from entering a gas analyzer, which is located at a downstream side of the reactor. An input reactant gas mixture comprising 2% CO and 10.5% $O_2$(balance He) is introduced at an upstream side of the reactor and is passed over the mixed metal oxide catalyst and through the reactor at a flow rate of about 1 liter/min. After attaining a steady state flow of gas, the temperature of the furnace is increased at a heating rate of from between about 1° C./min and 20° C./min. such as about 15° C./min. and the gas that passes over the mixed metal oxide catalyst (or comparative metal oxide) and emerges from the downstream side of the reactor (e.g., exhaust gas) is analyzed by a NGA 2000 Fisher-Rosemount MLT-4 multichannel analyzer, which measures the concentration of CO, $CO_2$and $O_2$ in the exhaust gas.

FIG. 1 A shows the variation of percentage conversion of CO to $CO_2$ with sample temperature for a 60 wt % CuO-40 wt. % $CeO_2$ mixed metal oxide catalyst prepared by heating in pure helium at 700° C. Curve (A) represents the percentage of CO conversion for the mixed metal oxide catalyst, and curves (B-C) represent the percentage of CO conversion for the constituent CuO and $CeO_2$ nanoscale particles, respectively.

Figure 1B:
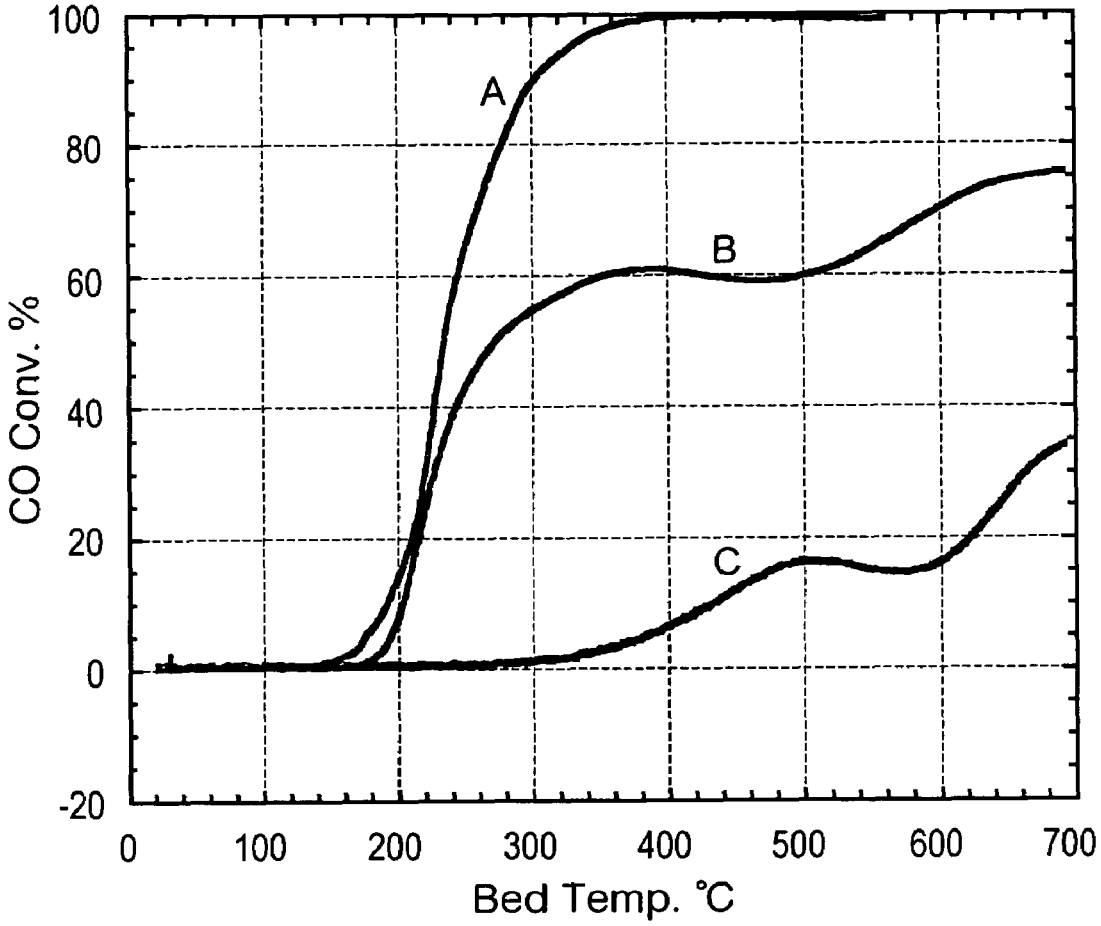
FIG. 1B shows the variation of percentage conversion of CO to $CO_2$ with sample temperature for a 60 wt % CuO-40 wt. % $TiO_2$ mixed metal oxide catalyst heated in pure helium at 700° C. Curve (A) represents the percentage of CO conversion for the mixed metal oxide catalyst, and curves (B-C) represent the percentage of CO conversion for the constituent CuO and $TiO_2$' nanoscale particles, respectively.

FIG. 1B shows the variation of percentage conversion of CO to $CO_2$ with sample temperature for a 60 wt % CuO-40 wt. % $TiO_2$ mixed metal oxide catalyst prepared by heated in pure helium at 700° C. Curve (A) represents the percentage of CO conversion for the mixed metal oxide catalyst, and curves (B-C) represent the percentage of CO conversion for the constituent CuO and $TiO_2$ nanoscale particles, respectively.

Carbon monoxide conversion data for different samples of mixed metal oxide catalysts are shown in Table I. The data report the temperature at which 5% of the carbon monoxide is converted to carbon dioxide ($T_5$) and the temperature at which 50% of the carbon monoxide is converted to carbon dioxide ($T_{50}$). The temperature at which 5% of the carbon monoxide is converted to carbon dioxide is referred to as the light-off temperature.

Referring to Table 1, the mixed metal oxide catalysts comprising copper oxide and cerium oxide (sample 1) and copper oxide and titanium oxide (sample 2) exhibit lower light off and $T_{50}$ temperatures than either of their two respective constituent nanoscale particles.

TABLE 1

$T_5$ (Light-off) and $T_{50}$ Temperatures for Mixed Metal Oxide Catalysts

| Sample | Composition | Surface Area ($m^2/g$) | | Temperature | |
|---|---|---|---|---|---|
| # | (wt. %) | as-rec'd | as-heated | $T_5$ (° C.) | $T_{50}$ (° C.) |
| A | CuO (comparative) | 45 | 2 | 200 | 280 |
| B | $CeO_2$ (comparative) | | | 340 | 550 |
| C | $TiO_2$ (comparative) | 400 | 1 | 400 | >700 |
| 1 | 60 CuO-40 $CeO_2$ | | | 185 | 240 |
| 2 | 60 CuO-40 $TiO_2$ | | 1.5 | 180 | 240 |

The method allows for dry, solvent-free formation of mixed metal oxide catalysts under sterile conditions.

In one preferred embodiment, the mixed metal oxide catalysts can be used in cut filler compositions, cigarette paper and/or cigarette filter material in order to reduce the amount of carbon monoxide in tobacco smoke, such as mainstream tobacco smoke or sidestream tobacco smoke. According to an embodiment, the mixed metal oxide catalysts can be used to catalyze and/or oxidize the conversion of carbon monoxide to carbon dioxide in the mainstream smoke of a cigarette.

The term "mainstream" smoke refers to the mixture of gases passing down the tobacco column and issuing through the filter end, i.e., the amount of smoke issuing or drawn from the mouth end of a cigarette during smoking of the cigarette. The term "sidestream" includes smoke given off into the surrounding air that does not exit through the mouth end of the smoking article. The mixed metal oxide catalysts can reduce the amount of carbon monoxide from mainstream smoke, i.e., by catalyzing and/or oxidizing the conversion of carbon monoxide into carbon dioxide.

An embodiment relates to a method for making a cigarette comprising a mixed metal oxide catalyst, comprising combining first nanoscale particles and second nanoscale particles to form a mixture of nanoscale particles, wherein first nanoscale particles comprise a first metallic element and second nanoscale particles comprise a second metallic element different from the first metallic element; heating the mixture of nanoscale particles to form a mixed metal oxide catalyst; incorporating the mixed metal oxide catalyst in and/or on at least one of tobacco cut filler, cigarette paper and cigarette filter material; providing the cut filler to a cigarette making machine to form a tobacco column; placing the paper around the tobacco column to form a tobacco rod of a cigarette and optionally attaching the tobacco rod to a cigarette filter with tipping paper. The cigarette filter can comprise mixed metal oxide catalysts.

Another embodiment relates to a method of making a component of a smoking article comprising mixed metal oxide catalysts, comprising combining first nanoscale particles and second nanoscale particles to form a mixture of nanoscale particles, wherein first nanoscale particles comprise a first metallic element and second nanoscale particles comprise a second metallic element different from the first metallic element; heating the mixture of nanoscale particles to form a mixed metal oxide catalyst; and incorporating the mixed metal oxide catalysts in and/or on at least one of tobacco cut filler, cigarette paper and cigarette filter material. The step of incorporating the mixed metal oxide catalyst in and/or on a smoking article component such as tobacco cut filler, cigarette paper and/or cigarette filter material can comprise spraying, dusting and/or mixing.

The amount of the mixed metal oxide catalysts can be selected such that the amount of carbon monoxide in mainstream smoke is reduced during smoking of a cigarette. Preferably, the amount of the mixed metal oxide catalysts will be a catalytically effective amount, e.g., an amount sufficient to oxidize and/or catalyze at least 10% of the carbon monoxide in mainstream smoke, more preferably at least 25%. For example, the amount of the mixed metal oxide catalyst can be from about a few milligrams, for example, about 5 mg/cigarette, to about 200 mg/cigarette. More preferably, the amount of the mixed metal oxide catalyst incorporated in a cigarette will be from about 10 mg/cigarette to about 100 mg/cigarette. Preferably, the mixed metal oxide catalysts are incorporated in an amount effective to reduce the ratio in mainstream smoke of carbon monoxide to total particulate matter (e.g., tar) by at least 10% (e.g., by at least 15%, 20%, 25%, 30%, 35%, 40% or 45%). Preferably, the mixed metal oxide catalysts comprise less than about 10% by weight of the smoking article component, more preferably less than about 5% by weight of the smoking article component.

In addition to the constituents in tobacco, the temperature and the oxygen concentration are factors affecting the formation and reaction of carbon monoxide and carbon dioxide during the smoking of a cigarette. The total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

During smoking there are three distinct regions in a cigarette: the combustion zone, the pyrolysis/distillation zone, and the condensation/filtration zone. While not wishing to be bound by theory, it is believed that the mixed metal oxide catalysts can target the various reactions that occur in different regions of the cigarette during smoking.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, water vapor and various organic compounds, the concentration of oxygen is low in the combustion zone. The low oxygen concentrations coupled with the high temperature leads to the reduction of carbon dioxide to carbon monoxide by the carbonized tobacco. In this region, the mixed metal oxide catalysts can convert carbon monoxide to carbon dioxide via both catalysis and oxidation mechanisms. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide is produced. The major reaction is the pyrolysis (i.e., the thermal degradation) of the tobacco that produces carbon monoxide, carbon dioxide, smoke components and charcoal using the heat generated in the combustion zone. There is some oxygen present in this region, and thus the mixed metal oxide catalysts may act as a catalyst for the oxidation of carbon monoxide to carbon dioxide. The catalytic reaction begins at 150° C. and reaches maximum activity around 300° C.

In the condensation/filtration zone the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level.

The mixed metal oxide catalysts as described above may be provided along the length of a tobacco column or at discrete locations along the length of a tobacco column. Furthermore, the mixed metal oxide catalysts may be homogeneously or inhomogeneously distributed along the cigarette paper and/or throughout the tobacco cut filler or cigarette filter material of a cigarette. The mixed metal oxide catalysts may be added to cut filler tobacco stock. The cut filler tobacco stock can be supplied to a cigarette making machine or used in a "make your own" cigarette. The mixed metal oxide catalysts may be deposited directly on a tobacco column prior to wrapping cigarette paper around the cigarette column. The mixed metal oxide catalysts may be deposited directly on and/or incorporated in cigarette paper before or after the cigarette paper is incorporated into a cigarette.

The mixed metal oxide catalysts can also be combined with cigarette filter material. A cigarette filter comprising the mixed metal oxide catalysts may be a mono filter, a dual filter, a triple filter, a cavity filter, a recessed filter or a free-flow filter. The mixed metal oxide catalysts can be incorporated into one or more cigarette filter parts selected from the group consisting of: a shaped paper insert, a plug, a space between plugs, cigarette filter paper, a cellulose acetate sleeve, a polypropylene sleeve, and a free-flow sleeve.

For example, the mixed metal oxide catalysts can be employed in a hollow portion of a cigarette filter. Some cigarette filters have a plug/space/plug configuration in which the plugs comprise a fibrous filter material and the space is a void between the two filter plugs. The mixed metal oxide catalysts can be provided within the void.

Mixed metal oxide catalysts will preferably be distributed throughout the tobacco column and/or along the cigarette paper portions of a cigarette. By providing the mixed metal oxide catalysts throughout the tobacco column and/or along the cigarette paper it is possible to reduce the amount of carbon monoxide drawn through the cigarette, and particularly at both the combustion region and in the pyrolysis zone.

A mixed metal oxide catalyst can be incorporated into smoking article components in a number of ways. Mixed metal oxide catalysts in the form of a dry powder can be dusted on cut filler tobacco and/or added to the raw materials used to make cigarette paper. The catalyst can also be combined with cigarette filter material during and/or after manufacture of the cigarette filter material. The mixed metal oxide catalysts can be mixed with water or other suitable liquid to form a paste or dispersion. A paste can be combined with the smoking article components prior to or during the cigarette manufacturing process. A dispersion can be coated such as by spray-coating onto the smoking article component. The smoking article component can then be incorporated into the cigarette making process.

One embodiment provides a method for forming a mixed metal oxide catalyst and then depositing the mixed metal oxide catalyst on tobacco cut filler in forming a cigarette.

Any suitable tobacco mixture may be used for the cut filler. Examples of suitable types of tobacco materials include flue-cured, Burley, Maryland or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The tobacco can also include tobacco substitutes.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives that are known in the art (e.g., burn additives, combustion modifying agents, coloring agents, binders, etc.).

A further embodiment provides a method of making a component of a smoking article comprising a mixed metal oxide catalyst, comprising incorporating the mixed metal oxide catalyst in and/or on at least one of tobacco cut filler, cigarette paper and cigarette filter material.

Techniques for cigarette manufacture are known in the art. Any conventional or modified cigarette making technique may be used to incorporate the mixed metal oxide catalysts. The resulting cigarettes can be manufactured to any known specifications using standard or modified cigarette making techniques and equipment. The cut filler composition is optionally combined with other cigarette additives, and provided to a cigarette making machine to produce a tobacco column, which is then wrapped in cigarette paper, and optionally tipped with filters.

Cigarettes may range from about 50 mm to about 120 mm in length. The circumference is from about 15 mm to about 30 mm in circumference, and preferably around 25 mm. The tobacco packing density is typically between the range of about 100 mg/cm$^3$ to about 300 mg/cm$^3$, and preferably 150 mg/cm$^3$ to about 275 mg/cm$^3$.

As mentioned above, the mixed metal oxide catalysts are useful for catalyzing reactions at low or ambient temperatures. The mixed metal oxide catalysts may also act as oxidants under certain temperature and oxygen depleted conditions. By "catalyzing" is meant that the mixed metal oxide catalysts affect the rate of a chemical reaction without themselves being consumed or undergoing a chemical change in the overall reaction. The mixed metal oxide catalysts can catalyze oxidation, reduction or conversion reactions, e.g., such as the oxidation of carbon monoxide, reduction of nitric oxide and/or conversion of hydrocarbons. In a preferred embodiment, the mixed metal oxide catalysts are used for the oxidation of carbon monoxide to carbon dioxide. An oxidant is capable of oxidizing a reactant, e.g., by donating oxygen to the reactant, such that the oxidant itself is reduced. The mixed metal oxide catalyst can convert carbon monoxide (e.g., carbon monoxide in mainstream smoke) to carbon dioxide via catalysis and/or oxidation.

Examples of smoking articles include, but are not limited to cigarettes, pipes, and cigars, as well as non-traditional cigarettes. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636. The mixed metal oxide catalyst can be dispersed in the smoking material or incorporated into cigarette paper and/or into a filter arrangement.

According to a further embodiment, a smoking article component such as tobacco cut filler, cigarette paper and cigarette filter material can comprise a mixed metal oxide catalyst. Furthermore, a cigarette comprising tobacco cut filler, cigarette paper and optional cigarette filter material can comprise the mixed metal oxide catalysts wherein the mixed metal oxide catalysts are incorporated in and/or on at least one of the tobacco cut filler, cigarette paper and filter material.

"Smoking" of a cigarette means the heating or combustion of the cigarette to form smoke, which can be drawn in through the cigarette. Generally, smoking of a cigarette involves lighting one end of the cigarette and drawing the smoke through the mouth end of the cigarette, while the tobacco contained therein undergoes a combustion reaction.

Another embodiment relates to a method for smoking a cigarette comprising the mixed metal oxide catalyst, comprising lighting the cigarette to form smoke and drawing the smoke through the cigarette, wherein during the smoking of the cigarette, the mixed metal oxide catalyst acts as a catalyst for the oxidation of carbon monoxide in mainstream tobacco smoke.

While various embodiments have been described, it is to be understood that variations and modifications may be resorted to as will be apparent to those skilled in the art. Such variations and modifications are to be considered within the purview and scope of the claims appended hereto.

All of the above-mentioned references are herein incorporated by reference in their entirety to the same extent as if each individual reference was specifically and individually indicated to be incorporated herein by reference in its entirety.

What is claimed is:

1. A component of a smoking article comprising a multiphase mixed metal oxide catalyst consisting of sintered nanoparticles of at least two metal oxides selected from the group consisting of copper oxide, cerium oxide, titanium oxide and iron oxide, wherein the component is selected from the group consisting of tobacco cut filler, cigarette paper and cigarette filter material.

2. The smoking article component of claim 1, wherein the mixed metal oxide catalyst is capable of catalyzing the conversion of carbon monoxide to carbon dioxide, and/or oxidizing carbon monoxide to carbon dioxide.

3. The smoking article component of claim 1, wherein the mixed metal oxide catalyst reduces the ratio in mainstream smoke of carbon monoxide to total particulate matter by at least about 10% during smoking.

4. The smoking article component of claim 1, wherein the mixed metal oxide catalyst has a mean particle size of less than about 1 micron.

5. The smoking article component of claim 1, wherein the mixed metal oxide catalyst comprises less than about 10 wt.% of the component.

6. The smoking article component of claim 1, wherein the mixed metal oxide catalyst has a surface area of greater than about 1 m$^2$/g.

7. A component of a smoking article comprising a multiphase mixed metal oxide catalyst consisting of sintered nanoparticles of at least two metal oxides selected from the group consisting of copper oxide, cerium oxide, titanium oxide and iron oxide, wherein (a) the component is selected from the group consisting of tobacco cut filler, cigarette paper and cigarette filter material, (b) the mixed metal oxide catalyst is capable of catalyzing the conversion of carbon monoxide to carbon dioxide, and/or oxidizing carbon monoxide to carbon dioxide, (c) the mixed metal oxide catalyst has a mean particle size of less than about 1 micron, (d) the mixed metal oxide catalyst comprises less than about 10 wt. % of the component, and (e) the mixed metal oxide catalyst has a surface area of greater than about 1 $m^2/g$.

* * * * *